US006813988B2

(12) United States Patent
Kruppa et al.

(10) Patent No.: US 6,813,988 B2
(45) Date of Patent: Nov. 9, 2004

(54) SEQUENTIAL HYDRAULIC EXTENSION SYSTEM

(76) Inventors: Leonard Kruppa, 3410 N. Range Rd., Temple, TX (US) 76502; Scott Jones, 3410 N. Range Rd., Temple, TX (US) 76502; Marlin Ritchie, 3410 N. Range Rd., Temple, TX (US) 76502; Mark Kosel, 3410 N. Range Rd., Temple, TX (US) 76502

( * ) Notice: Subject to any disclaimer, the term of this patent is extended or adjusted under 35 U.S.C. 154(b) by 0 days.

(21) Appl. No.: 10/365,588

(22) Filed: Feb. 12, 2003

(65) Prior Publication Data

US 2004/0154290 A1 Aug. 12, 2004

(51) Int. Cl.[7] ..... F01L 15/00
(52) U.S. Cl. ..... 91/189 R; 92/110
(58) Field of Search ..... 91/189 R, 189 A, 91/508, 520; 92/110, 111, 112

(56) References Cited

U.S. PATENT DOCUMENTS 3,609,974 A * 10/1971 Lado ..... 92/110
3,841,494 A * 10/1974 Chalupsky et al. ..... 91/168
4,613,257 A * 9/1986 Weirich et al. ..... 91/189 R
4,821,622 A * 4/1989 Burk ..... 91/189 R
5,355,769 A * 10/1994 Kottke ..... 91/189 R
5,501,346 A * 3/1996 Wimmer ..... 212/349
6,536,325 B2 * 3/2003 Badia Ba ..... 91/189 A

* cited by examiner

*Primary Examiner*—Thomas E. Lazo
(74) *Attorney, Agent, or Firm*—David G. Henry

(57) ABSTRACT

A serial, multi-unit hydraulic system which utilizes a single hydraulic fluid circuit each for extending and retracting all constituent hydraulic units. The fluid circuit for retraction of a remote hydraulic unit extends through intervening, primary hydraulic unit(s), and, after retraction of the remote hydraulic unit, provides retraction oil flow to primary hydraulic unit(s). Control valves effect a prescribed sequence of extension and retraction of the constituent hydraulic units, without involving separate, external control apparatuses.

1 Claim, 1 Drawing Sheet

SEQUENTIAL HYDRAULIC EXTENSION SYSTEM

BACKGROUND OF THE INVENTION

1. Field of the Invention

The present invention relates to hydraulic pistons and actuation apparatuses.

2. Background Information

Hydraulic piston and cylinder assemblies are used in almost countless contexts.

In certain situations, a series of hydraulic units are used to achieve a mechanical result which is not achievable through use of a single hydraulic unit. One example of such an arrangement is that of the stabilizing hydraulic boom assembly as used for portable cranes, "cherry pickers", ladder trucks for fire departments, etc. Such hydraulic boom assemblies presently include at least one hydraulic unit which is oriented for extending the boom assembly horizontally away from the vehicle, and a second hydraulic unit which is oriented vertically for raising and lowering ground-contacting pads or feet.

Presently, in this, and any other such multi-hydraulic unit system, each hydraulic unit requires its own hydraulic fluid circuit and actuation mechanisms (switches, valves, etc.). This can often involve considerable lengths of telescopic conduit and hoses, and, if such could be avoided as through application of the present invention, considerable duplication of expense for redundant actuators, valves, switches, etc. As with any mechanical system, the multiplying of components likewise multiplies the opportunities for mechanical failure or malfunction. In addition, the presence of exposed conduits and hoses over considerable lengths increases the likelihood of breach thereof and accompanying hydraulic system failures. This is particularly true with respect to exteriorly positioned, exposed telescopic conduits ("trombone tubes") which are particularly susceptible to damage and seal problems arising from particulate (dirt) contamination.

Providing a serial hydraulic unit system which obviates requirements for a number of independent hydraulic circuits and associated actuation systems equal to the number of hydraulic units would, at a minimum, reduce costs and hydraulic system complexities and, as will be discussed below, actually provide certain safety benefits when used in certain contexts. Further eliminating external, telescopic conduits for hydraulically feeding remote hydraulic cylinder units would eliminate many mechanical problems and associated costs.

It would be further beneficial to users of multiple hydraulic unit systems to provide such a system which, without requiring multiple, independent actuation systems, could be configured for extending and/or retracting hydraulic units in certain prescribed sequences.

Each of these objectives are left unsatisfied in the present art.

SUMMARY OF THE INVENTION

In view of the foregoing, it is an object of the present invention to provide an improved multiple hydraulic unit system.

It is another object of the present invention to provide an improved multiple hydraulic unit system which, when compared with conventional such systems, requires fewer components.

It is another object of the present invention to provide an improved multiple hydraulic unit system, each constituent hydraulic unit of which shares at least part of a hydraulic fluid circuit with another hydraulic unit in the same system.

It is another object of the present invention to provide an improved multiple hydraulic unit system, all constituent hydraulic units of which are assured to extend and/or retract upon completed actuation of the system.

It is another object of the present invention to provide an improved multiple hydraulic unit system, constituent hydraulic units of which extend and/or retract in a predetermined sequence.

It is another object of the present invention to provide an improved multiple hydraulic unit system, constituent hydraulic units of which extend and/or retract in a predetermined sequence, without requiring the outside actuation of separate control mechanisms for each such hydraulic unit.

It is another object of the present invention to provide an improved design for a multiple hydraulic unit system which involves a portion of the conduits thereof residing within, and extending through one or more of the constituent hydraulic unit cylinders, as opposed to residing outside of such cylinders to thereby be exposed to damage and/or environmental degradation.

In satisfaction of these and related objects, the present invention provides an serial, multi-unit hydraulic system which, though multiple hydraulic units (piston and cylinder assemblies) are actuated during any single operation of the system, uses merely a single hydraulic fluid circuit for extending and retracting all constituent hydraulic units. The incorporation and arrangement of certain control valves effects a prescribed sequence of extension and retraction of the constituent hydraulic units, without involving separate, external control apparatuses. The unique design of the present system involves the enclosure of certain conduits within hydraulic cylinders, which conduits would ordinarily reside outside of cylinders, exposed to potential damage and in environmental degradation.

Normal actuation of a serial, multi-unit hydraulic system of the present invention assuredly results in the full extension or retraction of all constituent hydraulic units. This is the result of the sharing of hydraulic fluid circuits between the constituent hydraulic units, and can provide significant safety dividends when such a system is used in certain contexts. For example, when a system of the present invention is used in the context of a lateral support boom assembly for a portable crane, or similar application, it is assured, upon proper operation of the system, that both the horizontal or vertical hydraulic units will extend and retract, thereby insuring that proper support it is provided during extension, and inadvertent entanglement with ground surfaces, surrounding structures, etc. will be avoided when the boom is intended to be fully retracted.

Furthermore, through use of certain integral pressure (control) valve arrangements, as will be described in more detail later herein, individual hydraulic units residing in systems of the present invention can be made to extend or retract in predetermined sequences, rather than as a result of separate actuation of independent, hydraulic unit-specific control systems. Again, using the example of a lateral support boom assembly, this can be quite beneficial in assuring, for example, that the horizontal hydraulic unit will first extend, followed by the vertical hydraulic unit, whereas. upon retraction, the vertical hydraulic unit will retract first, followed by he horizontal unit. Any reflection upon proper operation of a lateral support boom assembly will reveal the significance of such an operation, and the benefits of achieving such operation without requiring multiple, independent control mechanisms.

A core achievement of the present invention is the actuation and sequential control of a remote hydraulic unit despite such unit's sharing of a common hydraulic fluid circuit with an intermediate hydraulic unit in a serial arrangement. In addition, the elimination of external conduits as would otherwise be required for operating such a remote hydraulic unit, as made possible by the presently presented design, provides considerable advantages in system longevity and reduction in component redundancy.

DETAILED DESCRIPTION OF THE PREFERRED EMBODIMENT

Figure 1:
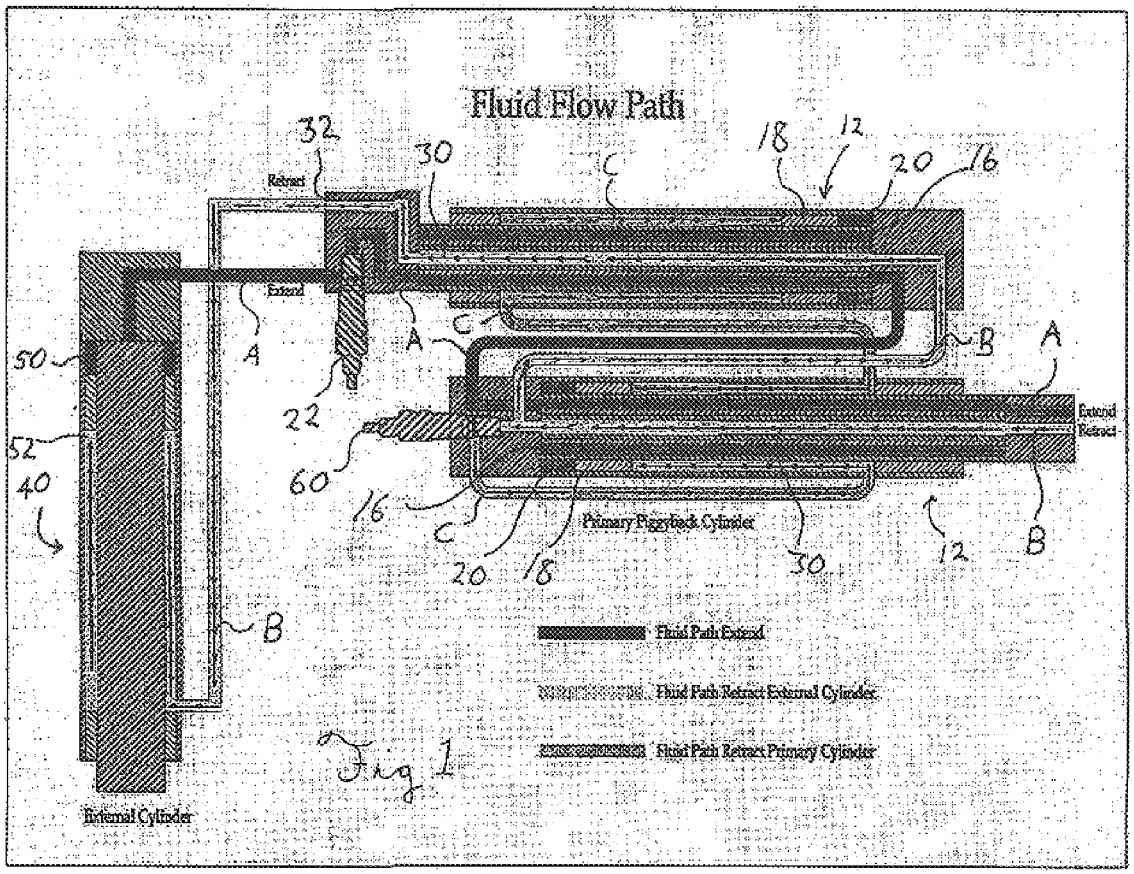
FIG. 1 is a schematic representation of a multi-unit hydraulic system of the present invention, wherein the fluid circuit for extension operations is depicted.

Referring to FIG. 1, a schematic representation of a multi-unit hydraulic system is shown with primary cylinder-piston assemblies ("primary hydraulic units") 12 and a remote hydraulic piston-cylinder assembly ("remote hydraulic unit") 40. A fluid path for hydraulic oil as effects the extension of primary hydraulic units 12 and remote hydraulic unit 40 is depicted by line A.

As an examination of FIG. 1 reveals, oil following fluid path A (with hydraulic oil entering the system from conventional hydraulic pump(s) which are not shown in the drawings) enters each of primary hydraulic units 12 (in a succession merely dictated by their order in fluid path A) on the interior side 18 of piston head 16 in the internal (extension side) cylinder bore 20 of each primary hydraulic unit 12.

To the first entry point at a primary hydraulic unit 12, fluid path A may be in the form of any conventional conduit which is suitable for the movement of the primary hydraulic unit 12 under normal operation. Once reaching the first (or only) primary hydraulic unit 12, fluid path A extends through and beyond the last internal cylinder bore 20 of a primary hydraulic unit 12 to a control valve 22.

Control valve 22 is in-line of fluid path A, distal of primary hydraulic unit(s) 12, and controls flow of oil as it exits the primary hydraulic units 12 and, upon opening of control valve 22, flows into the internal (extension side) cylinder bore 50 of remote hydraulic unit 40.

Control valve 22 is either pre-set or adjusted whereby it remains closed up to, but not in excess of a certain line pressure (a "pressure limit") in fluid path A. The selected pressure limit at which control valve 22 will open is selected such that control valve 22 will open (and allow flow of oil for extension of cylinder 40) only after primary hydraulic units 12 are fully extended and, as a result, pressure from the hydraulic pump(s) feeding hydraulic oil into fluid path A rises to meet or exceed the pressure limit. This pressure limit may vary depending on a number of factors, including the inherent resistance to movement of the primary hydraulic units components themselves, resistance to extension arising from orientation the cylinder pistons of the primary hydraulic units, and the resistance to movement offered by anything connected to the piston rods of the primary hydraulic units, which collective resistance must be overcome to fully extend the pistons of the primary hydraulic units. Clearly, the greater the force required to fully extend primary cylinder units 12, the higher the pressure limit for control valve 22 will be.

By virtue of the arrangement described above, primary hydraulic units 12 fully extend before remote cylinder 40 extends at all.

Referring again to FIG. 1, a fluid path B is depicted for demonstrating the path of hydraulic oil involved in retracting the remote hydraulic unit 40 and the primary hydraulic units 12 (in that order).

Hydraulic oil enters fluid path B and passes through primary hydraulic units 12 through internal trombone tube assemblies 30 which allow for extension and retraction of the conduits making up fluid path B and coextensive with primary hydraulic units 12, and which is completely isolated from the hydraulic oil (in fluid path A) which effects extension of the primary and remote hydraulic units 12 and 40. An additional conduit (not depicted in FIG. 2) extends from a distal terminus 32 of trombone tube assembly 30 (of the last sequential primary hydraulic unit 12) and carries oil into the external ("retraction side") cylinder bore 52 of remote hydraulic unit 40.

A retraction circuit control valve 60 is situated in fluid communication with fluid path B, via a branch of that conduit stream which extends to remote hydraulic unit 40. Control valve 60 is in a normally closed condition, whereby hydraulic oil in fluid path B reaches, but does not pass through control valve 60 until or unless a pre-determined pressure limit is reached. Thus, hydraulic oil in fluid path B, until or unless the pressure limit for control valve 60 is reached, only flows to remote hydraulic unit 40 to effect its retraction.

At retraction circuit control valve 60 is the genesis of fluid path C. Fluid path C carries hydraulic oil from control valve 60 (when open) sequentially to external cylinder bores 24 of primary hydraulic units 12 to effect their retraction.

As with the sequencing of extension of hydraulic units via the controlled hydraulic oil flow in fluid path A, the governing of fluid paths B and C as described assure that a desired sequence of hydraulic unit retraction is achieved.

With the pressure limit for control valve 60 being set to a high enough level that remote hydraulic unit 40 will reliably and fully retract at a line pressure (in fluid path B) which is less than the pressure limit, remote hydraulic unit 40 will always retract before primary hydraulic units 12 retract.

The preferred embodiment of the present invention involves isolating the fluid path involved in retracting the remote hydraulic unit 40 of the present system from the fluid path which extends it and the primary hydraulic units 12, yet extends this retraction fluid path through the interior of primary hydraulic units. This avoids the limitations of exterior conduits as described above and, upon actuation of control valve 60, effects the retraction of primary hydraulic units 12 with a mere extension of this same fluid path.

The ability to both extend and retract a remote, slaved hydraulic unit with a hydraulic fluid circuit shared with one or more intervening hydraulic units is significant without more. However, to further be capable of effecting an extend last, retract first sequencing via a vis the intervening hydraulic unit(s), without separate unit control systems, is a significant achievement.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A multi-unit hydraulic system comprising:

a primary hydraulic unit including a primary hydraulic cylinder and piston assembly;

a remote hydraulic unit including a remote hydraulic cylinder and piston assembly;

a first extension fluid path extending from a pressurized hydraulic oil source, into an extension side cylinder bore of said primary hydraulic unit and terminating downstream of said extension side cylinder bore of said primary hydraulic unit at a first control valve, said first control valve having an input orifice for receiving hydraulic oil through said first extension fluid path and an outflow orifice in fluid communication with a second extension fluid path, said second extension fluid path extending from said first control valve to an extension side cylinder bore of said remote hydraulic unit, said first control valve changing from a normally closed to an open configuration for allowing flow of said hydraulic oil into said second extension fluid path for effecting extension of said remote hydraulic unit when line pressure in said first extension fluid path reaches a first pressure limit of said first control valve;

a first retraction fluid path extending from a pressurized hydraulic oil source, through said primary hydraulic unit into a retraction side cylinder bore of said remote hydraulic unit, and terminating downstream of said remote hydraulic unit at a second control valve, said second control valve having an input orifice for receiving hydraulic oil through said first retraction fluid path and an outflow orifice in fluid communication with a second retraction fluid path, said second retraction fluid path extending from said second control valve to an retraction side cylinder bore of said primary hydraulic unit, said second control valve changing from a normally closed to an open configuration for allowing flow of said hydraulic oil into said second retraction fluid path for effecting retraction of said primary hydraulic unit when line pressure in said first retraction fluid path reaches a second pressure limit of said second control valve.

* * * * *